US009957875B2

(12) United States Patent
Gonze et al.

(10) Patent No.: US 9,957,875 B2
(45) Date of Patent: May 1, 2018

(54) COOLANT PUMP CONTROL SYSTEMS AND METHODS FOR BACKPRESSURE COMPENSATION

(71) Applicant: GM Global Technology Operations LLC, Detroit, MI (US)

(72) Inventors: Eugene V. Gonze, Pinckney, MI (US); Vijay Ramappan, Novi, MI (US); Yue-Ming Chen, Canton, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 543 days.

(21) Appl. No.: 14/494,904

(22) Filed: Sep. 24, 2014

(65) Prior Publication Data

US 2016/0047291 A1 Feb. 18, 2016

Related U.S. Application Data

(60) Provisional application No. 62/036,766, filed on Aug. 13, 2014.

(51) Int. Cl.

| | |
|---|---|
| ***F01P 7/14*** | (2006.01) |
| ***F01P 3/20*** | (2006.01) |
| ***F01P 5/10*** | (2006.01) |
| ***F01P 7/16*** | (2006.01) |

(52) U.S. Cl.

CPC ..... *F01P 7/14* (2013.01); *F01P 3/20* (2013.01); *F01P 5/10* (2013.01); *F01P 7/164* (2013.01); *F01P 2025/06* (2013.01)

(58) Field of Classification Search

CPC ..... F01P 7/164; F01P 7/14; F01P 7/167

USPC ..... 123/41.08, 41.01, 41.02, 178

See application file for complete search history.

(56) References Cited

U.S. PATENT DOCUMENTS

| | | | | |
|---|---|---|---|---|
| 4,197,712 | A * | 4/1980 | Zwick | F17C 9/02 60/618 |
| 5,724,924 | A | 3/1998 | Michels | |
| 6,568,428 | B2 | 5/2003 | Pecci et al. | |
| 6,994,316 | B2 | 2/2006 | Pervaiz | |
| 7,296,543 | B2 | 11/2007 | Namuduri et al. | |
| 9,080,573 | B2 | 7/2015 | Welte et al. | |
| 9,683,561 | B2 | 6/2017 | Ruhle et al. | |

(Continued)

FOREIGN PATENT DOCUMENTS

| | | | |
|---|---|---|---|
| CN | 101067395 | A | 11/2007 |
| CN | 101109310 | A | 1/2008 |

(Continued)

OTHER PUBLICATIONS

U.S. Appl. No. 14/495,037, filed Sep. 24, 2014, Gonze et al.

(Continued)

*Primary Examiner* — Marguerite McMahon
*Assistant Examiner* — James Kim

(57) ABSTRACT

A target speed module determines a target speed of an engine coolant pump of the vehicle. A speed adjustment module determines a speed adjustment based on a position of a valve, wherein a backpressure of the engine coolant pump changes when the position of the valve changes. An adjusted target speed module determines an adjusted target speed for the engine coolant pump based on the target speed and the speed adjustment. A speed control module controls a speed of the engine coolant pump based on the adjusted target speed.

20 Claims, 5 Drawing Sheets

(56) References Cited

U.S. PATENT DOCUMENTS

| | | | | |
|---|---|---|---|---|
| 2003/0019442 | A1 | 1/2003 | Yoshikawa et al. | |
| 2004/0035194 | A1 | 2/2004 | Wakahara | |
| 2007/0234980 | A1 | 10/2007 | Namuduri et al. | |
| 2007/0272173 | A1* | 11/2007 | Reckels | F01P 7/167 123/41.11 |
| 2009/0301409 | A1 | 12/2009 | Dahl et al. | |
| 2012/0137991 | A1* | 6/2012 | Pae | F01P 7/164 123/41.1 |
| 2012/0204818 | A1 | 8/2012 | Welte et al. | |
| 2012/0296547 | A1 | 11/2012 | Bialas et al. | |
| 2015/0027572 | A1 | 1/2015 | Morein et al. | |
| 2015/0053777 | A1 | 2/2015 | Iwasaki | |

FOREIGN PATENT DOCUMENTS

| | | | |
|---|---|---|---|
| CN | 102635556 | A | 8/2012 |
| CN | 103975180 | A | 8/2014 |
| DE | 102013109365 | A1 | 3/2015 |
| JP | 2007023989 | A | 2/2007 |
| JP | 2011089480 | A | 5/2011 |
| JP | 2013194716 | A | 9/2013 |

OTHER PUBLICATIONS

U.S. Appl. No. 14/495,141, filed Sep. 24, 2014, Gonze et al.
U.S. Appl. No. 14/495,265, filed Sep. 24, 2014, Gonze et al.
First Office Action for Chinese Application No. 201510495052.5 dated Aug. 3, 2017 with English translation; 19 pages.

* cited by examiner

COOLANT PUMP CONTROL SYSTEMS AND METHODS FOR BACKPRESSURE COMPENSATION

CROSS-REFERENCE TO RELATED APPLICATIONS

This application claims the benefit of U.S. Provisional Application No. 62/036,766, filed on Aug. 13, 2014. The disclosure of the above application is incorporated herein by reference in its entirety.

This application is related to U.S. patent application Ser. No. 14/495,037, which is filed on the same day as this application and claims the benefit of U.S. Provisional Application No. 62/036,814 filed on Aug. 13, 2014; Ser. No. 14/495,141 filed on the same day as this application and claims the benefit of U.S. Provisional Application No. 62/036,833 filed on Aug. 13, 2014; and Ser. No. 14/495,265 filed on the same day as this application and claims the benefit of U.S. Provisional Application No. 62/036,862 filed on Aug. 13, 2014. The entire disclosures of the above applications are incorporated herein by reference.

FIELD

The present disclosure relates to vehicles with internal combustion engines and more particularly to systems and methods for controlling engine coolant flow.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An internal combustion engine combusts air and fuel within cylinders to generate drive torque. Combustion of air and fuel also generates heat and exhaust. Exhaust produced by an engine flows through an exhaust system before being expelled to atmosphere.

Excessive heating may shorten the lifetime of the engine, engine components, and/or other components of a vehicle. As such, vehicles that include an internal combustion engine typically include a radiator that is connected to coolant channels within the engine. Engine coolant circulates through the coolant channels and the radiator. The engine coolant absorbs heat from the engine and carries the heat to the radiator. The radiator transfers heat from the engine coolant to air passing the radiator. The cooled engine coolant exiting the radiator is circulated back to the engine.

SUMMARY

In a feature, a coolant control system for a vehicle is disclosed. A target speed module determines a target speed of an engine coolant pump of the vehicle. A speed adjustment module determines a speed adjustment based on a position of a valve, wherein a backpressure of the engine coolant pump changes when the position of the valve changes. An adjusted target speed module determines an adjusted target speed for the engine coolant pump based on the target speed and the speed adjustment. A speed control module controls a speed of the engine coolant pump based on the adjusted target speed.

In further features, a backpressure module that determines the backpressure of the engine coolant pump based on the position of the valve, wherein the speed adjustment module determines the speed adjustment based on the backpressure.

In further features, the speed adjustment module: increases the speed adjustment as the backpressure decreases; and decreases the speed adjustment as the backpressure increases.

In further features, the adjusted target speed module: increases the adjusted target speed as the speed adjustment increases; and decreases the adjusted target speed as the speed adjustment decreases.

In further features, the adjusted target speed module sets the adjusted target speed equal to one of: a sum of the target speed and the speed adjustment; and a product of the target speed and the speed adjustment.

In further features, the speed adjustment module determines the speed adjustment further based on a second position of a second valve that controls coolant flow through a block portion of an engine.

In further features, the speed adjustment module determines the speed adjustment further based on a second position of a second valve that controls coolant flow through a heater core of the vehicle.

In further features, the target speed module determines the target speed of the engine coolant pump based on a target flowrate of engine coolant through an engine of the vehicle.

In further features, the target speed module determines the target speed of the engine coolant pump based on an engine torque, an engine speed, a temperature of engine coolant input to the engine, and a temperature of engine coolant output from the engine.

In further features, the speed control module controls electrical power applied to the engine coolant pump based on the adjusted target speed.

A coolant control method for a vehicle includes: determining a target speed of an engine coolant pump of the vehicle; determining a speed adjustment based on a position of a valve, wherein a backpressure of the engine coolant pump changes when the position of the valve changes; determining an adjusted target speed for the engine coolant pump based on the target speed and the speed adjustment; and controlling a speed of the engine coolant pump based on the adjusted target speed.

In further features, the coolant control method further includes: determining the backpressure of the engine coolant pump based on the position of the valve; and determining the speed adjustment based on the backpressure.

In further features, the coolant control method further includes: increasing the speed adjustment as the backpressure decreases; and decreasing the speed adjustment as the backpressure increases.

In further features, the coolant control method further includes: increasing the adjusted target speed as the speed adjustment increases; and decreasing the adjusted target speed as the speed adjustment decreases.

In further features, the coolant control method further includes setting the adjusted target speed equal to one of: a sum of the target speed and the speed adjustment; and a product of the target speed and the speed adjustment.

In further features, the coolant control method further includes: determining the speed adjustment further based on a second position of a second valve that controls coolant flow through a block portion of an engine.

In further features, the coolant control method further includes: determining the speed adjustment further based on a second position of a second valve that controls coolant flow through a heater core of the vehicle.

In further features, the coolant control method further includes: determining the target speed of the engine coolant pump based on a target flowrate of engine coolant through an engine of the vehicle.

In further features, the coolant control method further includes: determining the target speed of the engine coolant pump based on an engine torque, an engine speed, a temperature of engine coolant input to the engine, and a temperature of engine coolant output from the engine.

In further features, the coolant control method further includes: controlling electrical power applied to the engine coolant pump based on the adjusted target speed.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

An engine combusts air and fuel to generate drive torque. A coolant system includes a coolant pump that circulates coolant through various portions of the engine, such as a cylinder head, an engine block, and an integrated exhaust manifold (IEM). Traditionally, the engine coolant is used to absorb heat from the engine, engine oil, transmission fluid, and other components and to transfer heat to air via one or more heat exchangers. A coolant valve controls how coolant flows back to the coolant pump and through various components.

A pump control module controls the coolant pump based on a target flowrate of coolant through the engine. Backpressure on the coolant pump, however, affects the output of the coolant pump. Actuation of the coolant valve affects the backpressure on the coolant pump.

The pump control module of the present disclosure determines a target speed for the coolant pump based on the target flowrate of coolant through the engine. The pump control module also determines a speed adjustment for the target speed based on a position of the coolant valve. The pump control module adjusts the target speed based on the speed adjustment and controls the speed of the coolant pump based on the adjusted target speed. Adjusting the target speed based on the speed adjustment adjusts the target speed to account for backpressure on the coolant pump.

Figure 1:
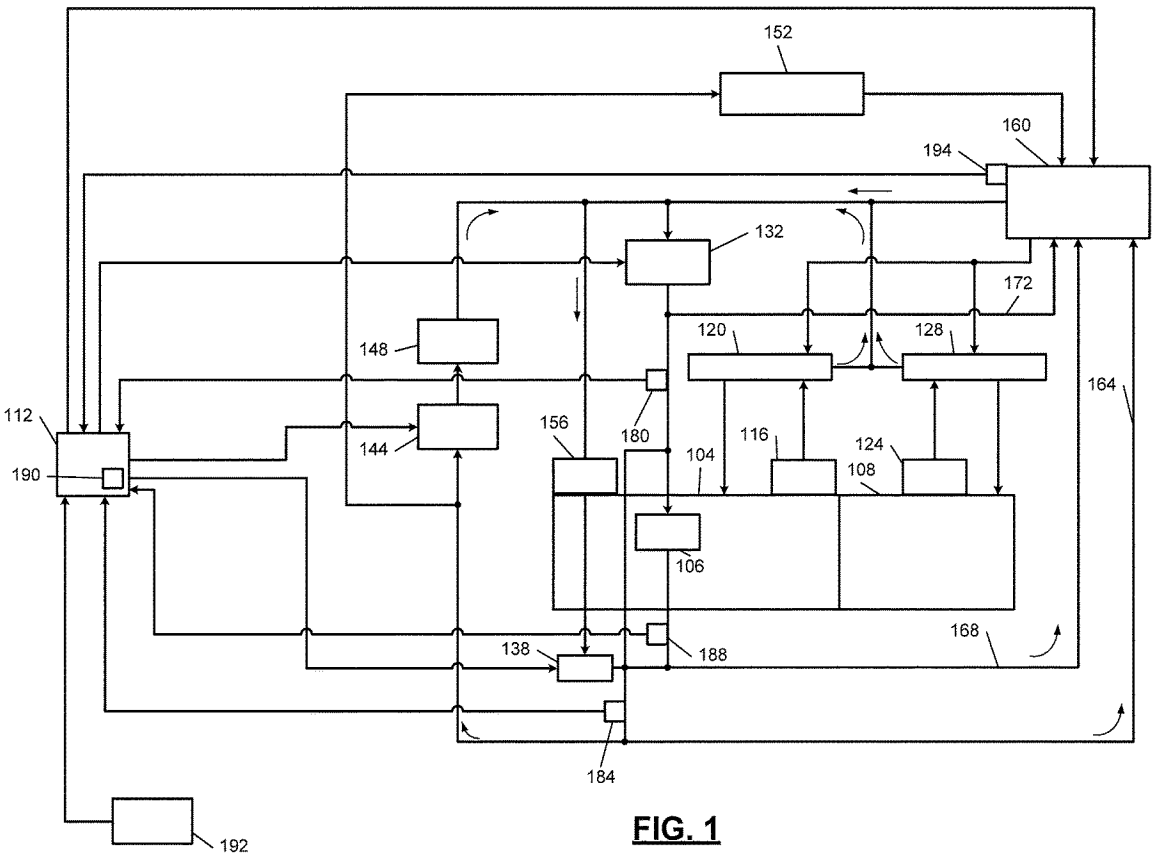
FIG. 1 is a functional block diagram of an example vehicle system.

Referring now to FIG. 1, a functional block diagram of an example vehicle system is presented. An engine 104 combusts a mixture of air and fuel within cylinders to generate drive torque. An integrated exhaust manifold (IEM) 106 receives exhaust output from the cylinders and is integrated with a portion of the engine 104, such as a head portion of the engine 104.

The engine 104 outputs torque to a transmission 108. The transmission 108 transfers torque to one or more wheels of a vehicle via a driveline (not shown). An engine control module (ECM) 112 may control one or more engine actuators to regulate the torque output of the engine 104.

An engine oil pump 116 circulates engine oil through the engine 104 and a first heat exchanger 120. The first heat exchanger 120 may be referred to as an (engine) oil cooler or an oil heat exchanger (HEX). When the engine oil is cold, the first heat exchanger 120 may transfer heat to engine oil within the first heat exchanger 120 from coolant flowing through the first heat exchanger 120. The first heat exchanger 120 may transfer heat from the engine oil to coolant flowing through the first heat exchanger 120 and/or to air passing the first heat exchanger 120 when the engine oil is warm.

A transmission fluid pump 124 circulates transmission fluid through the transmission 108 and a second heat exchanger 128. The second heat exchanger 128 may be referred to as a transmission cooler or as a transmission heat exchanger. When the transmission fluid is cold, the second heat exchanger 128 may transfer heat to transmission fluid within the second heat exchanger 128 from coolant flowing through the second heat exchanger 128. The second heat exchanger 128 may transfer heat from the transmission fluid to coolant flowing through the second heat exchanger 128 and/or to air passing the second heat exchanger 128 when the transmission fluid is warm.

The engine 104 includes a plurality of channels through which engine coolant ("coolant") can flow. For example, the engine 104 may include one or more channels through the head portion of the engine 104, one or more channels through a block portion of the engine 104, and/or one or more channels through the IEM 106. The engine 104 may also include one or more other suitable coolant channels.

When a coolant pump 132 is on, the coolant pump 132 pumps coolant to various channels. While the coolant pump 132 is shown and will be discussed as an electric coolant pump, the coolant pump 132 may alternatively be mechanically driven (e.g., by the engine 104) or another suitable type of variable output coolant pump.

A block valve (BV) 138 may regulate coolant flow out of (and therefore through) the block portion of the engine 104. A heater valve 144 may regulate coolant flow to (and therefore through) a third heat exchanger 148. The third heat exchanger 148 may also be referred to as a heater core. Air may be circulated past the third heat exchanger 148, for example, to warm a passenger cabin of the vehicle.

Coolant output from the engine 104 also flows to a fourth heat exchanger 152. The fourth heat exchanger 152 may be referred to as a radiator. The fourth heat exchanger 152 transfers heat to air passing the fourth heat exchanger 152. A cooling fan (not shown) may be implemented to increase airflow passing the fourth heat exchanger 152.

Various types of engines may include one or more turbochargers, such as turbocharger 156. Coolant may be circulated through a portion of the turbocharger 156, for example, to cool the turbocharger 156.

A coolant valve 160 may include a multiple input, multiple output valve or one or more other suitable valves. In various implementations, the coolant valve 160 may be partitioned and have two or more separate chambers. An example diagram illustrating coolant flow to and from an example where the coolant valve 160 includes 2 coolant chambers is provided in FIG. 2. The ECM 112 controls actuation of the coolant valve 160.

Figure 2:
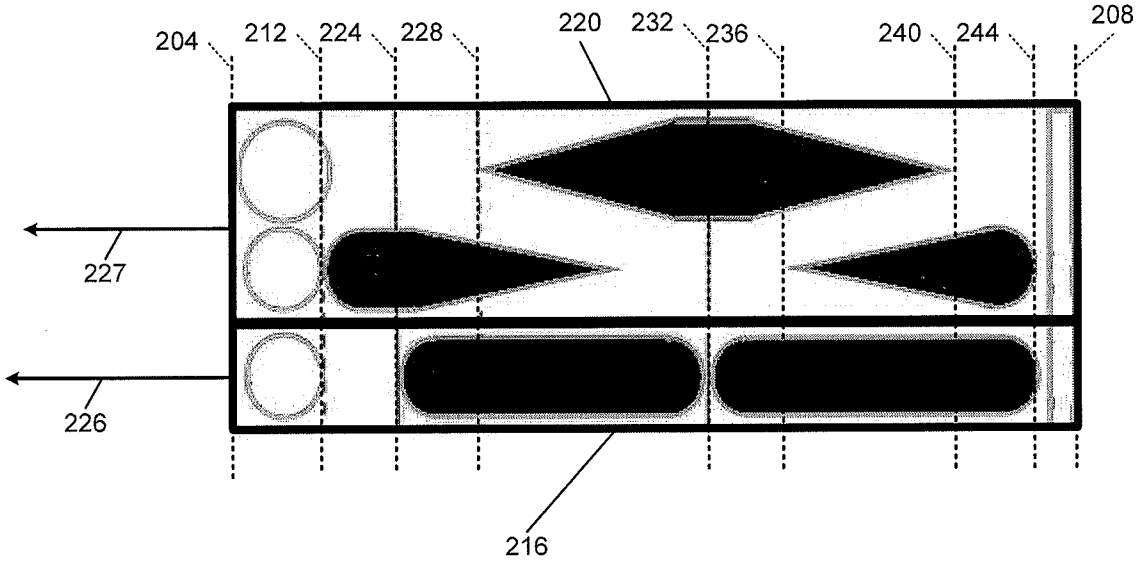
FIG. 2 is an example diagram illustrating coolant flow to and from a coolant valve for various positions of the coolant valve.

Referring now to FIGS. 1 and 2, the coolant valve 160 can be actuated between two end positions 204 and 208. When the coolant valve 160 is positioned between the end position 204 and a first position 212, coolant flow into a first one of the chambers 216 is blocked, and coolant flow into a second one of the chambers 220 is blocked. The coolant valve 160 outputs coolant from the first one of the chambers 216 to the first heat exchanger 120 and the second heat exchanger 128 as indicated by 226. The coolant valve 160 outputs coolant from the second one of the chambers 220 to the coolant pump 132 as indicated by 227.

When the coolant valve 160 is positioned between the first position 212 and a second position 224, coolant flow into the first one of the chambers 216 is blocked and coolant output by the engine 104 flows into the second one of the chambers 220 via a first coolant path 164. Coolant flow into the second one of the chambers 220 from the fourth heat exchanger 152, however, is blocked.

When the coolant valve 160 is positioned between the second position 224 and a third position 228, coolant output by the IEM 106 via a second coolant path 168 flows into the first one of the chambers 216, coolant output by the engine 104 flows into the second one of the chambers 220 via the first coolant path 164, and coolant flow into the second one of the chambers 220 from the fourth heat exchanger 152 is blocked. The ECM 112 may actuate the coolant valve 160 to between the second and third positions 224 and 228, for example, to warm the engine oil and the transmission fluid.

When the coolant valve 160 is positioned between the third position 228 and a fourth position 232, coolant output by the IEM 106 via the second coolant path 168 flows into the first one of the chambers 216, coolant output by the engine 104 flows into the second one of the chambers 220 via the first coolant path 164, and coolant output by the fourth heat exchanger 152 flows into the second one of the chambers 220. Coolant flow into the first one of the chambers 216 from the coolant pump 132 via a third coolant path 172 is blocked when the coolant valve 160 is between the end position 204 and the fourth position 232. The ECM 112 may actuate the coolant valve 160 to between the third and fourth positions 228 and 232, for example, to warm the engine oil and the transmission fluid.

When the coolant valve 160 is positioned between the fourth position 232 and a fifth position 236, coolant output by the coolant pump 132 flows into the first one of the chambers 216 via the third coolant path 172, coolant flow into the second one of the chambers 220 via the first coolant path 164 is blocked, and coolant output by the fourth heat exchanger 152 flows into the second one of the chambers 220. When the coolant valve 160 is positioned between the fifth position 236 and a sixth position 240, coolant output by the coolant pump 132 flows into the first one of the chambers 216 via the third coolant path 172, coolant output by the engine 104 flows into the second one of the chambers 220 via the first coolant path 164, and coolant output by the fourth heat exchanger 152 flows into the second one of the chambers 220.

When the coolant valve 160 is positioned between the sixth position 240 and a seventh position 244, coolant output by the coolant pump 132 flows into the first one of the chambers 216 via the third coolant path 172, coolant output by the engine 104 flows into the second one of the chambers 220 via the first coolant path 164, and coolant flow from the fourth heat exchanger 152 into the second one of the chambers 220 is blocked.

Coolant flow into the first one of the chambers 216 from the IEM 106 via the second coolant path 168 is blocked when the coolant valve 160 is between the fourth position 232 and the seventh position 244. The ECM 112 may actuate the coolant valve 160 to between the fourth and seventh positions 232 and 244, for example, to cool the engine oil and the transmission fluid. Coolant flow into the first and second chambers 216 and 220 is blocked when the coolant valve 160 is positioned between the seventh position 244 and the end position 208. The ECM 112 may actuate the coolant valve 160 to between the seventh position 244 and the end position 208, for example, for performance of one or more diagnostics.

Referring back to FIG. 1, a coolant input temperature sensor 180 measures a temperature of coolant input to the engine 104. A coolant output temperature sensor 184 measures a temperature of coolant output from the engine 104. An IEM coolant temperature sensor 188 measures a temperature of coolant output from the IEM 106. A coolant valve position sensor 194 measures a position of the coolant valve 160. One or more other sensors 192 may be implemented, such as an oil temperature sensor, a transmission fluid temperature sensor, one or more engine (e.g., block and/or head) temperature sensors, a radiator output temperature sensor, a crankshaft position sensor, a mass air flowrate (MAF) sensor, a manifold absolute pressure (MAP) sensor, and/or one or more other suitable vehicle sensors. One or more other heat exchangers may also be implemented to aid in cooling and/or warming of vehicle fluid(s) and/or components.

Output of the coolant pump 132 varies as the pressure of coolant input to the coolant pump 132 varies. For example, at a given speed of the coolant pump 132, the output of the coolant pump 132 increases as the pressure of coolant input to the coolant pump 132 increases, and vice versa. The position of the coolant valve 160 varies the pressure of coolant input to the coolant pump 132. A coolant control module 190 (see also FIG. 3) controls the speed of the coolant pump 132 based on the position of the coolant valve 160 to more accurately control the output of the coolant pump 132. While the coolant control module 190 is illustrated as being located within the ECM 112, the coolant control module 190 may be implemented within another module or independently.

Figure 3:
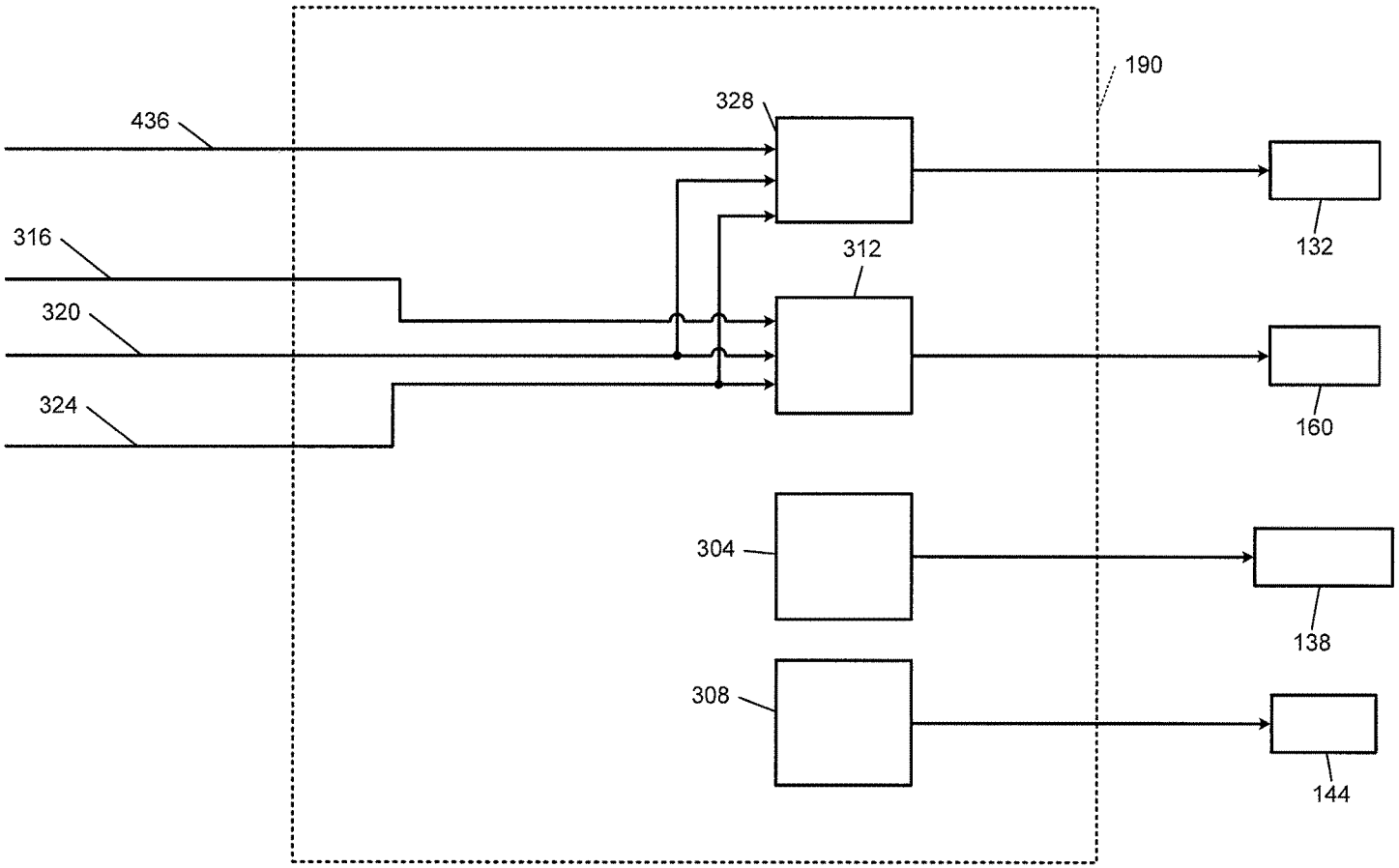
FIG. 3 is a functional block diagram of an example coolant control module.

Referring now to FIG. 3, a functional block diagram of an example implementation of the coolant control module 190 is presented. A block valve control module 304 controls the block valve 138. For example, the block valve control module 304 controls whether the block valve 138 is open (to allow coolant flow through the block portion of the engine 104) or closed (to prevent coolant flow through the block portion of the engine 104).

A heater valve control module 308 controls the heater valve 144. For example, the heater valve control module 308 controls whether the heater valve 144 is open (to allow coolant flow through the third heat exchanger 148) or closed (to prevent coolant flow through the third heat exchanger 148).

A coolant valve control module 312 controls the coolant valve 160. As described above, the position of the coolant valve 160 controls coolant flow into the chambers of the coolant valve 160 and also controls coolant flow out of the coolant valve 160. The coolant valve control module 312 may control the coolant valve 160, for example, based on an IEM coolant temperature 316, an engine coolant output temperature 320, an engine coolant input temperature 324, and/or one or more other suitable parameters. The IEM coolant temperature 316, the engine coolant output temperature 320, and the engine coolant input temperature 324 may be, for example, measured using the IEM coolant temperature sensor 188, the coolant input temperature sensor 180, and the coolant output temperature sensor 184, respectively.

Figure 4:
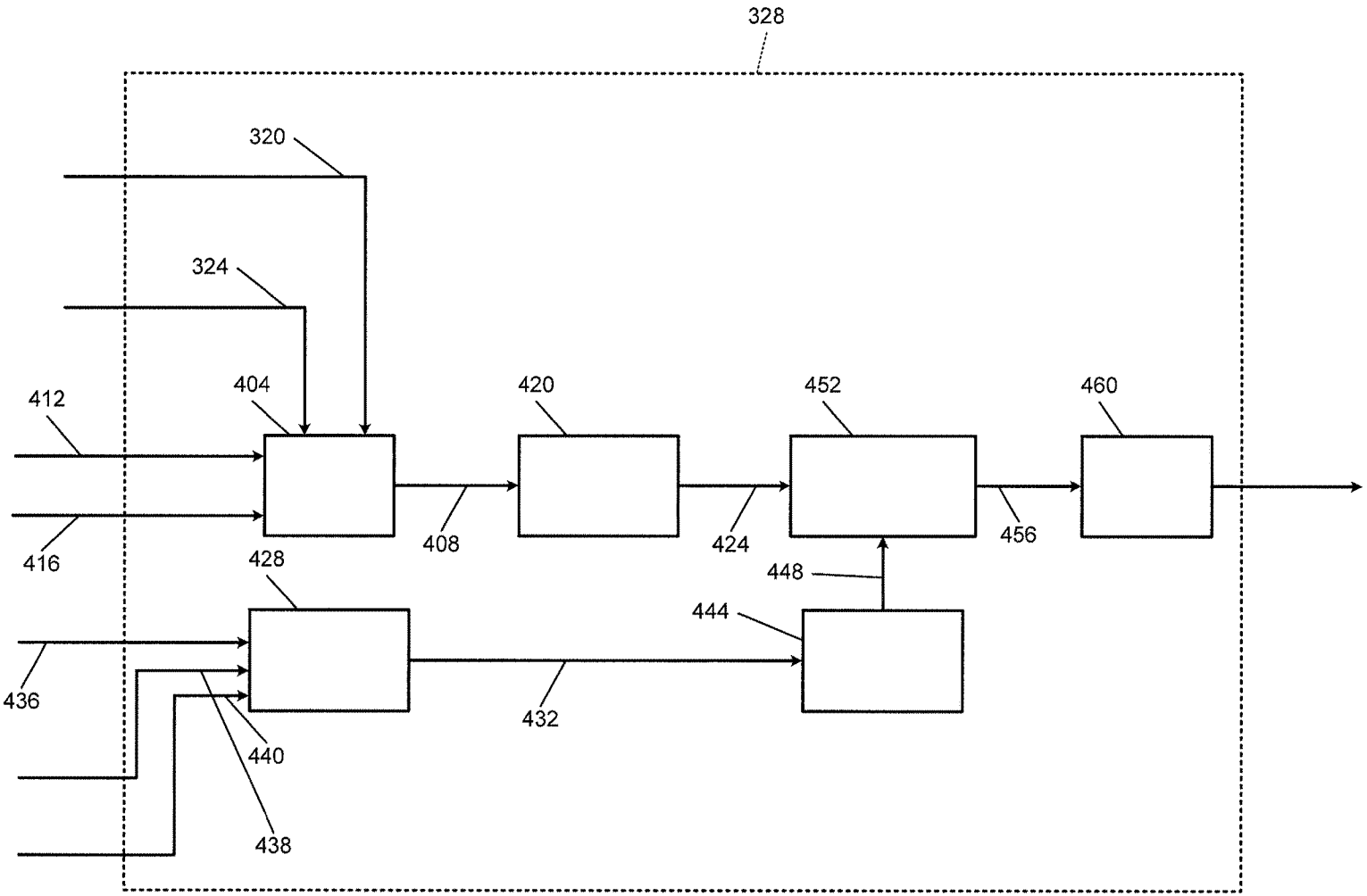
FIG. 4 is a functional block diagram of an example pump control module.

FIG. 4 includes a functional block diagram of an example pump control module 328. The pump control module 328 controls the coolant pump 132. Referring now to FIGS. 3 and 4, a target flowrate module 404 determines a target coolant flowrate 408 through the engine 104. The target flowrate module 404 determines the target coolant flowrate 408 based on an engine torque 412, an engine speed 416, the engine coolant input temperature 324, and the engine coolant output temperature 320. For example only, the target flowrate module 404 may determine the target coolant flowrate 408 using one or more functions and/or mappings (e.g., tables) that relate the engine torque 412, the engine speed 416, the engine coolant input temperature 324, and the engine coolant output temperature 320 to the target coolant flowrate 408. The engine speed 416 may be, for example, measured using a sensor. The engine torque 412 may be correspond to a requested engine torque output and may be determined, for example, based on one or more driver inputs, such as an accelerator pedal position and/or brake pedal position. Alternatively, the engine torque 412 may correspond to a torque output of the engine and may be measured using a sensor or calculated based on one or more other parameters.

A target speed module 420 determines a target speed 424 of the coolant pump 132 based on the target coolant flowrate 408. For example, the target speed module 420 may determine the target speed 424 using a function or a mapping that relates the target coolant flowrate 408 to the target speed 424.

As described above, even at a given speed, the output of the coolant pump 132 varies as the pressure of coolant input to the coolant pump 132 changes. The pressure of coolant input to the coolant pump 132 varies as the position of the coolant valve 160 changes. The pressure of the coolant input to the coolant pump 132 may also vary based on the position of the block valve 138 and/or the position of the heater valve 144.

A backpressure module 428 may determine a backpressure 432 of the coolant pump 132. The backpressure 432 corresponds to the pressure of coolant input to the coolant pump 132. The backpressure module 428 determines the backpressure 432 based on a position 436 of the coolant valve 160. The position 436 may be, for example, measured using the coolant valve position sensor 194. Alternatively, the position commanded by the coolant valve control module 312 may be used. The backpressure module 428 may determine the backpressure 432 using a function or a mapping that relates the position 436 of the coolant valve 160 to the backpressure 432.

The backpressure module 428 may determine the backpressure 432 further based on a position 438 of the block valve 138 and/or a position 440 of the heater valve 144. The backpressure module 428 may determine the backpressure 432 using one or more functions and/or mappings that relate the position 436 of the coolant valve 160, the position 438 of the block valve 138, and the position 440 of the heater valve 144 to the backpressure 432.

A speed adjustment module 444 determines a speed adjustment 448 for the target speed 424 based on the backpressure 432. The speed adjustment module 444 may determine the speed adjustment 448, for example, using a function or a mapping that relates the backpressure 432 to the speed adjustment 448. The speed adjustment module 444 may, for example, decrease the speed adjustment 448 (to decrease the target speed 424) as the backpressure increases, and vice versa.

In various implementations, the speed adjustment module 444 may determine the speed adjustment 448 based on the position 436 of the coolant valve 160. The speed adjustment module 444 may determine the speed adjustment 448 further based on the position 440 of the heater valve 144 and/or the position 438 of the block valve 138. In this manner, the determination of the backpressure 432 may be omitted.

An adjusted target speed module 452 adjusts the target speed 424 based on the speed adjustment 448 to determine an adjusted target speed 456 for the coolant pump 132. For example only, the adjusted target speed module 452 may set the adjusted target speed 456 equal to one of: a product of the target speed 424 and the speed adjustment 448; and a sum of the target speed 424 and the speed adjustment 448. While the examples of multiplication and addition are provided, the adjusted target speed module 452 may adjust the target speed 424 based on the speed adjustment 448 in another suitable manner to obtain the adjusted target speed 456.

A speed control module 460 controls the coolant pump 132 to achieve the adjusted target speed 456. For example, the speed control module 460 may control the application of electrical power to the coolant pump 132 to achieve the adjusted target speed 456.

Figure 5:
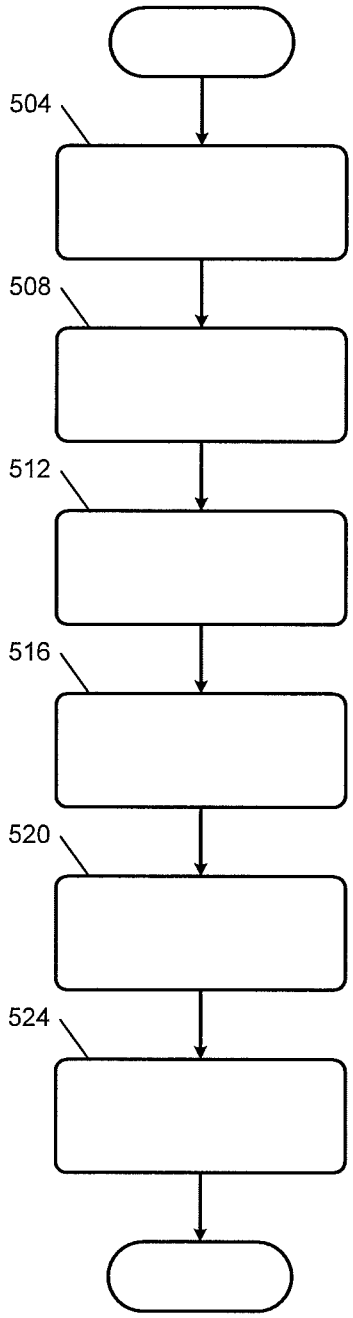
FIG. 5 is a flowchart depicting an example method of controlling a coolant pump.

Referring now to FIG. 5, a flowchart depicting an example method of controlling the coolant pump 132 is presented. Control may begin with 504 where the target flowrate module 404 determines the target coolant flowrate 408 of coolant through the engine 104. The target flowrate module 404 may determine the target coolant flowrate 408 based on the engine torque 412, the engine speed 416, the engine coolant output temperature 320, and the engine coolant input temperature 324.

At 508, the target speed module 420 determines the target speed 424 based on the target coolant flowrate 408. The backpressure module 428 may determine the backpressure 432 of the coolant pump 132 at 512 based on the position 436 of the coolant valve 160. The backpressure module 428 may determine the backpressure 432 further based on the position 438 of the block valve 138 and/or the position 440 of the heater valve 144.

The speed adjustment module 444 determines the speed adjustment 448 at 516. The speed adjustment module 444 may determine the speed adjustment 448 based on the backpressure 432. Alternatively, the speed adjustment module 444 may determine the speed adjustment 448 based on the coolant valve position 436 and neither, one, or both of the positions 438 and 440.

At 520, the adjusted target speed module 452 adjusts the target speed 424 based on the speed adjustment 448 to produce the adjusted target speed 456. For example, the adjusted target speed module 452 may set the adjusted target speed 456 equal to a sum of or a product of the target speed 424 and the speed adjustment 448. Adjusting the target speed 424 based on the speed adjustment 448 compensates for backpressure on the coolant pump 132. At 524, the speed control module 460 controls the coolant pump 132 to achieve the adjusted target speed 456. While control is shown as ending after 524, the example of FIG. 5 may be performed iteratively.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A OR B OR C), using a non-exclusive logical OR, and should not be construed to mean "at least one of A, at least one of B, and at least one of C." It should be understood that one or more steps within a method may be executed in different order (or concurrently) without altering the principles of the present disclosure.

In this application, including the definitions below, the term 'module' or the term 'controller' may be replaced with the term 'circuit.' The term 'module' may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium include nonvolatile memory circuits (such as a flash memory circuit or a mask read-only memory circuit), volatile memory circuits (such as a static random access memory circuit and a dynamic random access memory circuit), and secondary storage, such as magnetic storage (such as magnetic tape or hard disk drive) and optical storage.

The apparatuses and methods described in this application may be partially or fully implemented by a special purpose computer created by configuring a general purpose computer to execute one or more particular functions embodied in computer programs. The computer programs include processor-executable instructions that are stored on at least one non-transitory, tangible computer-readable medium. The computer programs may also include or rely on stored data. The computer programs may include a basic input/output system (BIOS) that interacts with hardware of the special purpose computer, device drivers that interact with particular devices of the special purpose computer, one or more operating systems, user applications, background services and applications, etc.

The computer programs may include: (i) assembly code; (ii) object code generated from source code by a compiler; (iii) source code for execution by an interpreter; (iv) source code for compilation and execution by a just-in-time compiler, (v) descriptive text for parsing, such as HTML (hypertext markup language) or XML (extensible markup language), etc. As examples only, source code may be written in C, C++, C#, Objective-C, Haskell, Go, SQL, Lisp, Java®, ASP, Perl, Javascript®, HTML5, Ada, ASP (active server pages), Perl, Scala, Erlang, Ruby, Flash®, Visual Basic®, Lua, or Python®.

None of the elements recited in the claims is intended to be a means-plus-function element within the meaning of 35 U.S.C. §112(f) unless an element is expressly recited using the phrase "means for", or in the case of a method claim using the phrases "operation for" or "step for".

What is claimed is:

1. A coolant control system for a vehicle, comprising:

a target speed module that determines a target speed of an engine coolant pump of the vehicle;

a speed adjustment module that determines a speed adjustment based on a position of a valve, wherein a backpressure of the engine coolant pump changes when the position of the valve changes;

an adjusted target speed module that determines an adjusted target speed for the engine coolant pump based on the target speed and the speed adjustment; and a speed control module that controls a speed of the engine coolant pump based on the adjusted target speed.

2. The coolant control system of claim 1 further comprising a backpressure module that determines the backpressure of the engine coolant pump based on the position of the valve, wherein the speed adjustment module determines the speed adjustment based on the backpressure.

3. The coolant control system of claim 2 wherein the speed adjustment module:

increases the speed adjustment as the backpressure decreases; and decreases the speed adjustment as the backpressure increases.

4. The coolant control system of claim 3 wherein the adjusted target speed module:

increases the adjusted target speed as the speed adjustment increases; and decreases the adjusted target speed as the speed adjustment decreases.

5. The coolant control system of claim 1 wherein the adjusted target speed module sets the adjusted target speed equal to one of:

a sum of the target speed and the speed adjustment; and a product of the target speed and the speed adjustment.

6. The coolant control system of claim 1 wherein the speed adjustment module determines the speed adjustment further based on a second position of a second valve that controls coolant flow through a block portion of an engine.

7. The coolant control system of claim 1 wherein the speed adjustment module determines the speed adjustment further based on a second position of a second valve that controls coolant flow through a heater core of the vehicle.

8. The coolant control system of claim 1 wherein the target speed module determines the target speed of the engine coolant pump based on a target flowrate of engine coolant through an engine of the vehicle.

9. The coolant control system of claim 1 wherein the target speed module determines the target speed of the engine coolant pump based on an engine torque, an engine speed, a temperature of engine coolant input to the engine, and a temperature of engine coolant output from the engine.

10. The coolant control system of claim 1 wherein the speed control module controls electrical power applied to the engine coolant pump based on the adjusted target speed.

11. A coolant control method for a vehicle, comprising:

determining a target speed of an engine coolant pump of the vehicle;

determining a speed adjustment based on a position of a valve, wherein a backpressure of the engine coolant pump changes when the position of the valve changes;

determining an adjusted target speed for the engine coolant pump based on the target speed and the speed adjustment; and controlling a speed of the engine coolant pump based on the adjusted target speed.

12. The coolant control method of claim 11 further comprising:

determining the backpressure of the engine coolant pump based on the position of the valve; and determining the speed adjustment based on the backpressure.

13. The coolant control method of claim 12 further comprising:

increasing the speed adjustment as the backpressure decreases; and decreasing the speed adjustment as the backpressure increases.

14. The coolant control method of claim 13 further comprising:

increasing the adjusted target speed as the speed adjustment increases; and decreasing the adjusted target speed as the speed adjustment decreases.

15. The coolant control method of claim 11 further comprising setting the adjusted target speed equal to one of:

a sum of the target speed and the speed adjustment; and a product of the target speed and the speed adjustment.

16. The coolant control method of claim 11 further comprising determining the speed adjustment further based on a second position of a second valve that controls coolant flow through a block portion of an engine.

17. The coolant control method of claim 11 further comprising determining the speed adjustment further based on a second position of a second valve that controls coolant flow through a heater core of the vehicle.

18. The coolant control method of claim 11 further comprising determining the target speed of the engine coolant pump based on a target flowrate of engine coolant through an engine of the vehicle.

19. The coolant control method of claim 11 further comprising determining the target speed of the engine coolant pump based on an engine torque, an engine speed, a temperature of engine coolant input to the engine, and a temperature of engine coolant output from the engine.

20. The coolant control method of claim 11 further comprising controlling electrical power applied to the engine coolant pump based on the adjusted target speed.

* * * * *